United States Patent [19]

Wirth et al.

[11] 4,100,650

[45] Jul. 18, 1978

[54] ADJUSTABLE FEED PLATE

[75] Inventors: Walter Wirth; Robert Siegmund, both of Dulmen; Wilhelm Borgert, Rorup, all of Fed. Rep. of Germany

[73] Assignee: Hergeth KG Muschinenfabrik und Apparatebann, Fed. Rep. of Germany

[21] Appl. No.: 727,442

[22] Filed: Sep. 28, 1976

Related U.S. Application Data

[63] Continuation of Ser. No. 567,409, Apr. 11, 1975, abandoned.

[30] Foreign Application Priority Data

Apr. 17, 1974 [DE] Fed. Rep. of Germany ..... 2418413

[51] Int. Cl.[2] ..... D01G 15/40

[52] U.S. Cl. ..... 19/105

[58] Field of Search ..... 19/88, 89, 86, 95, 105, 19/155, 156, 156.3, 156.4, 83, 98

[56] References Cited

U.S. PATENT DOCUMENTS

| | | | |
|---|---|---|---|
| 485,272 | 11/1992 | Groom | 19/96 |
| 2,157,684 | 5/1939 | Williams et al. | 19/89 |
| 2,726,423 | 12/1955 | Harwood et al. | 19/156.3 |
| 3,768,119 | 10/1973 | Wood | 19/89 |
| 3,797,074 | 3/1974 | Zafiroglu | 19/156.3 |
| 4,001,916 | 1/1977 | Grimshaw et al. | 19/105 X |

FOREIGN PATENT DOCUMENTS

| | | | |
|---|---|---|---|
| 1,432,694 | 2/1966 | France | 19/89 |
| 364,403 | 11/1922 | Fed. Rep. of Germany | 19/105 |
| 1,510,473 | 11/1969 | Fed. Rep. of Germany | 19/105 |
| 1,113,025 | 5/1968 | United Kingdom | 19/89 |

*Primary Examiner*—Mervin Stein
*Assistant Examiner*—Andrew M. Falik

[57] ABSTRACT

Apparatus for feeding fibrous material to a carding machine including a rotatable roll having an exterior cylindrical surface which with first and second surfaces in opposing relationship thereto defines a curved trough converging from an entrance end portion thereof in a direction of travel of the fibrous material through the trough, a tear-off point upstream of an exit end portion of the trough, the radius of curvature of the first and second surface being identical and corresponding to the radius of the first surface, and an imaginary straight line through the tear-off point being in tangential relationship to the second surface and the cylindrical surface.

7 Claims, 3 Drawing Figures

ADJUSTABLE FEED PLATE

This application is a continuation application of earlier copending commonly assigned application Ser. No. 567,409 filed Apr. 11, 1975 in the names of Walter Wirth, Robert Siegmund and Wilhelm Bogert entitled Apparatus for Feeding Fibrous Material to a Carding Machine or the Like, and now abandoned.

The present invention relates to an apparatus or machine for feeding carding machines, carding-combs or the like, as well as similar flock and band-opening units of carding and spinning machines by means of a feed trough between an intake cylinder and an opener roll.

Apparatus of the latter-mentioned type operates for feeding fibrous material of different length fibers and, in conjunction therewith, it is known that when a feed trough is used between an intake cylinder and an opener roll as associated fiber support surface of the feed trough must be regulated in length depending upon the length of the fibers of the material delivered therethrough in order to obtain a gentle combing-out of the fibers. Moreover, the comb length of the feed trough must be designed to accommodate for the length of the fiber staple because if the comb length is less than that of the fiber staple the fiber band or the fibrous material which is being combed out will be insufficiently supported by the opener roll. In the latter case the combing effect to achieve desired fiber separation is inefficient and optimum through-put through the machine is not achieved.

When the comb length, i.e., length of the trough, is too great compared to the fiber length or fiber staple the space between the entrance of the feed trough and the opener roll is too large to obtain effective combing-out of individual fibers when the latter are in the clamped state. Thus, in order to obtain optimal carding results it is necessary to adapt the dimensions of the trough, both in length and shape, to the particular fiber material being fed therethrough at any given time.

In conventional carding machines and machines with flock or band-opening units various approximating constructions have been built for the most usual fiber length ranges (25, 40, 50, 60 and 80mm), and various trough plates are kept available in order to obtain optimal combing. Depending, of course, upon the particular fiber length or fiber staple the appropriate trough plate is inserted into the machine, as required. Obviously this requires considerable outlay and multiple costs in the production of the trough plates.

In many cases a plate is used to extend the length of the feed trough with the plate being screwed to the trough plate. However, such a plate is unsuitable for satisfactory fixing of the comb length and of the position of the fiber tear-off point, particularly when the feeding machine has a large working width.

In keeping with the foregoing it is a primary object of this invention to provide a novel feed trough in conjunction with an intake cylinder for different lengths of fibers in which it is possible to rapidly and simply extend the trough to ensure desired comb length and specifically the position of the fiber tear-off point to an associated opener roll, even when operating with large widths of fibrous material.

In keeping with the present invention the apparatus includes intake and opener rolls or rollers in which a feed trough is defined by a trough plate having a support surface opposing a peripheral surface of the opener roll, and means are provided as a removable beam associated with the fiber support surface of the trough plate for lengthening or shortening a predetermined trough length, as might be desired depending upon fiber length and/or consistency, etc.

The latter-defined construction avoids considerable costs in, for example, providing several different trough plates for a carding machine in the manner heretofore disclosed as being conventional in the prior art. This same construction permits a rapid change of simply a portion of an overall desired trough length and therefore accommodates the machine for several fiber staple ranges so that various fiber staples can be optimally combed out.

In keeping with this invention the beam serves in effect to extend the trough and thus a nominal fiber support surface and comb length can be extended to a tear-off point and can be done so with both strength and rigidity, not to mention the fact that the disposition of the tear-off point can be located in the orientation direction of the machine at a predetermined point toward but not at the exit of the trough. Furthermore, since the conventional trough plate remains unaltered the only item needing change or alteration is one or more beams constructed in accordance with this invention which can be exchanged conveniently with little down time as fiber staple or length dictates.

The interchangeable nature of the beam or fiber support wedge is achieved by mounting the same within a groove of the conventional trough plate and preferably the mounting occurs on an underside of the trough plate by means of brackets, angle irons or the like. In this way vibrationless mounting of the fiber supporting wedge or beam is obtained and forces acting on the fibrous material are absorbed through the beam and the additional retaining means so that the stresses are removed from the trough comb. In this way the trough plate is virtually the same dimensions as a conventional trough plate, particularly in regard to the thickness thereof. Moreover, the formation of the trough plate is thus independent of the length of the comb length and the fiber support surface which contributes considerably to a cost savings.

Depending upon the nature of the fibrous material the working surface of the beam may be planar or curved, and either case may be tangential to the tear-off point of the opener roll or roller. Consequently it is possible to adapt the length of the fiber support surface and the spacing between the opener roller and the trough comb by the size of the slot width on the trough comb, to the fiber staple, in such a way that the most gentle combing out of the fibers results. In accordance with a further object of this invention the common carrier for the trough plate or beam is adjusted toward and away from the opener roll or roller in order to enlarge or reduce the trough therebetween which results in a considerable advantage by reducing down time for dismantling, reassembling, etc. In addition, means are provided for securing the intake roll or roller to the carrier and due to this construction there is no impairment to a previously established position of the intake roll or roller relative to the trough plate and accordingly a resetting of the latter relationship is eliminated.

With the above and other objects in view that will hereinafter appear, the nature of the invention will be more clearly understood by reference to the following detailed description, the appended claimed subject matter, and the several views illustrated in the accompanying drawings.

IN THE DRAWINGS

Figure 1:
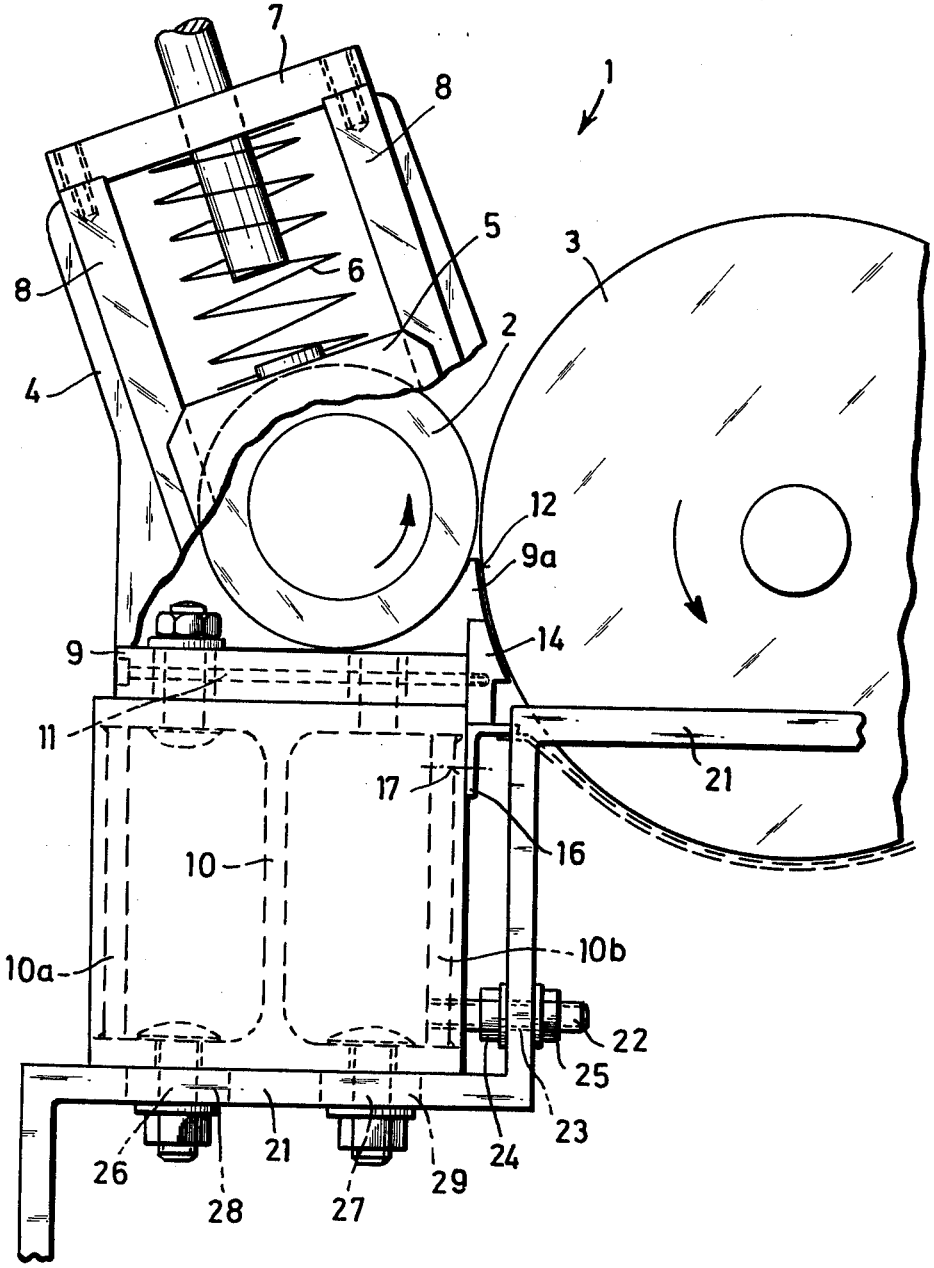
FIG. 1 is a schematic fragmentary side elevational view of a novel apparatus for feeding a carding machine in accordance with this invention, and illustrates the manner in which a trough is established between a wedge-like beam member and an associated roller.
Figure 2:
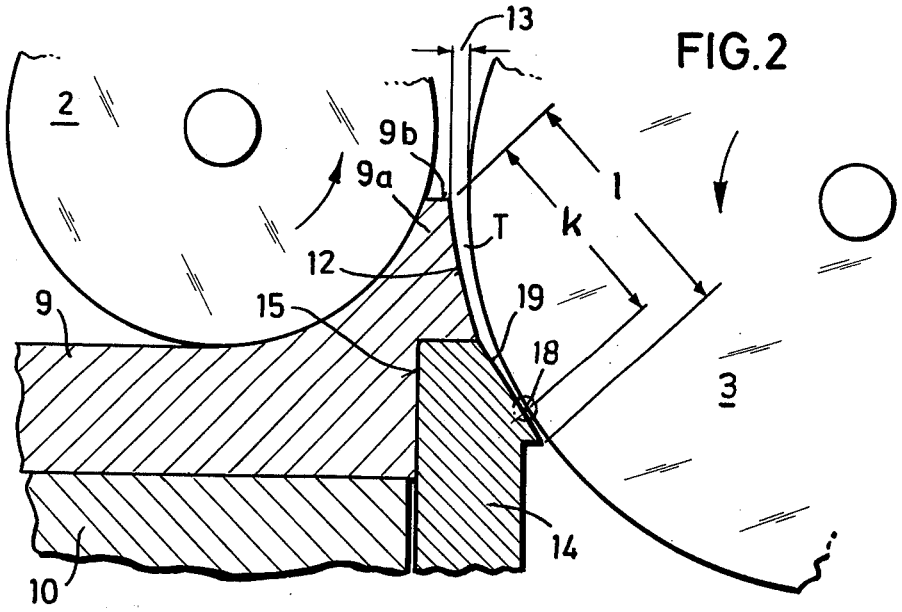
FIG. 2 is a fragmentary schematic view with portions in cross-section, and illustrates means cooperative with a peripheral surface of a roller for variably lengthening the predetermined length of a trough to assure optimum throughput of fibrous material through the trough irrespective of fiber length.

Reference is specifically made to FIGS. 1 and 2 which disclose an apparatus or machine, generally designated by the reference numeral 1, for feeding fibrous material to a carding machine or the like. The apparatus 1 is designed for combing out flocks, bands, fleeces, and the like of fibrous material by means of a feed trough T (FIG. 2), and includes an intake roll, roller, or cylinder 2 and an opener cylinder, roll or roller 3 which are suitably mounted for rotation in opposite directions, as indicated by the unnumbered headed arrows associated therewith. The roll 2 is adjustably slideably carried in a frame 4 by means of a slide 5 in which it is suitably journaled for rotation (not shown), and the slide 5 is urged downwardly, as viewed in FIG. 1, by a compression spring 6 sandwiched between the slide 5 and a cross piece 7 bolted or otherwise secured to guides or guide plates 8, 8 of the frame 4.

A trough plate 9 (FIG. 1) is supported atop a box-shaped carrier 10 by means of suitable nuts and bolts (unnumbered). The trough plate 9 includes an upright portion **9*a* (FIG. 2) having an upper planar surface or trough comb 9*b* downwardly from which extends a generally arcuate surface 12 defining with a periphery (unnumbered) the trough T having a maximum dimension 13 (FIG. 2). A lower portion of the surface 12 is defined by the support, wedge or wedge piece 9 which is a solid beam of metallic material having a length corresponding to the axial length of the rolls 2, 3. Means, generally designated by the reference numeral 14, cooperative with the peripheral surface (unnumbered) of the roll 3 is provided for variably lengthening the predetermined length of the trough T to assure optimum through-put of fibrous material through the trough T irrespective to the fiber length. The means 14 is likewise a beam having a length corresponding to the axial length of the roll 3 and is seated within a groove 15 of the trough plate 9 and supported therein by retaining means 16 (FIG. 1) which may be one or more angle irons or brackets secured to the carrier 10 by bolts, nuts, or combinations thereof, generally designated by the reference numeral 17. The beam 14 may be attached to the trough plate 9 by generally horizontally disposed screws and/or bolts 11 and/or to the carrier 10. It is, however, important to note that the beam 14 is interchangeable in order to obtain an optimum fiber support length L which is the entire length of the trough T and an optimum comb length K which is the distance measured from the planar surface 9*b* to a tear-off point 18** within the length L.

Figure 3:
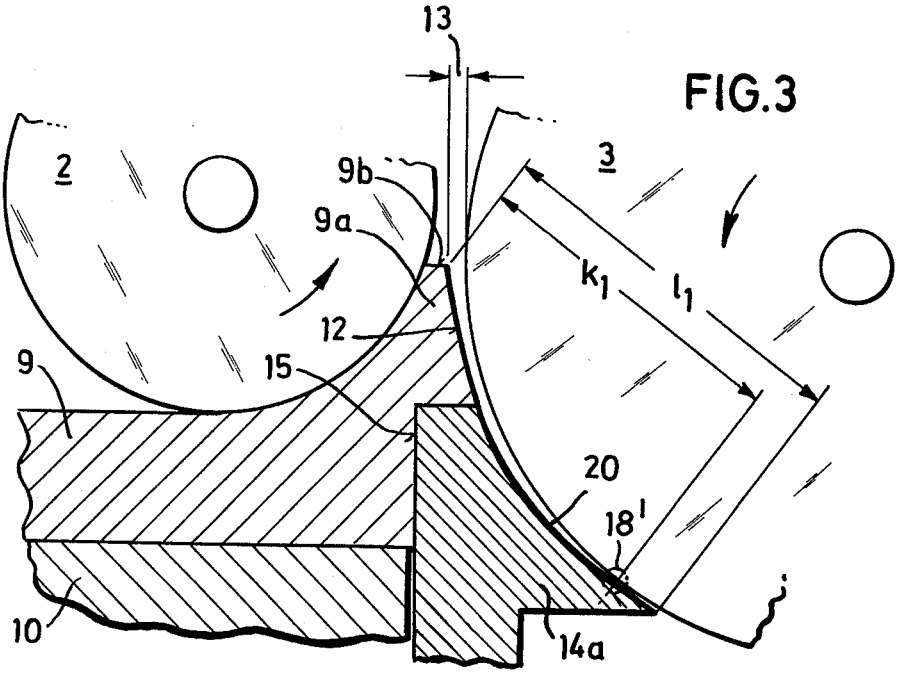
FIG. 3 is a view similar to FIG. 2, and illustrates a modification in the construction of a beam whose supporting surface constitutes an arcuate continuation of the infeed trough.

In accordance with the embodiment of the invention illustrated in FIG. 2 a surface 19 of the means 14 is uniplanar (flat), as opposed to a surface 20 (FIG. 3) of the embodiment of the invention illustrated in FIG. 3 which is arcuate and forms a continuation of the surface 12 of the trough plate 9. The surface 19 is preferably tangential to the roll 3 at the tear-off point 18.

For combing out medium and long-stapled or long-length fibers (about 65 – 250mm) the embodiment of the invention illustrated in FIG. 3 is preferably used with the tear-off point being generally designated by the reference numeral 18' being again located at a point of tangency between the curvatures of the surface 20 and the peripheral surface (unnumbered) of the roll 3. Due to the curvature of the surface 20 it is possible to achieve the gentlest possible combing-out of the fibers particularly in view of the fact that the length L1 of the combined surfaces 12, 20 is increased due to the curvature of the surface 20, as compared to the length L of the embodiment of the invention illustrated in FIG. 2.

In each embodiment of the invention (FIGS. 2 and 3) the carrier 10 is preferably a box carrier and for this purpose a broad flange carrier is utilized provided at opened side thereof with reinforcements **10*a*, 10*b* (FIG. 1). The box carrier 10 is adjustably secured upon a frame 21 of the machine by means of threaded bolts 22 which are passed through holes 23 in the machine frame 21 and fastened to the carrier 10. On both sides of the machine frame 21 nuts 24, 25 are associated with the threaded bolts 22 in order to anchor any predetermined position of adjustment of the carrier frame 10. In addition the carrier 10 is anchored to the machine frame 21 by bolts 26, 27 passed through longitudinal holes 28, 29 of the machine frame 21**.

In accordance with the construction heretofore described relative to all of the Figures of the drawings the trough plate 9, the support or beam 14 or **14*a*, and the overall support unit or retainer 16, the carrier 10, the holder 4, and the intake roll 2 are a unitized component which is movable, adjustable and lockable relative to the machine frame 21 as an integral component. This results in simple dismantling and reassembly for exchanging the fiber support wedges or beams 14. Thus the particular position of the intake roll 2 relative to the trough plate 9 remains unchanged and as a result of the adjustability of the integral component heretofore described the trough opening 13** can be reduced or enlarged in order to obtain effective combing out of the individual fibers in dependence, of course, upon the length thereof.

While preferred forms and arrangements of parts have been shown in illustrating the invention, it is to be clearly understood that various changes in detail and arrangement of parts may be made without departing from the spirit and scope of this disclosure.

We claim:

1. Apparatus for feeding fibrous material to a carding machine or the like ocmprising at least one rotatable roll having an exterior cylindrical surface, first and second separate curved surfaces both in opposing relationship to said cylindrical surface and defining therewith a trough through which is adapted to pass the fibrous material, said first surface preceding said second surface in the direction of travel of the fibrous material through said trough, said second surface defining an immediate generally unbroken smooth continuation of said first surface, said trough including an entrance end portion defined by an upstreammost end of said first surface and said cylindrical surface adapted to initially receive the fibrous material, said trough having an exit end portion defined between said second surface and said cylindrical surface from which is adapted to exit the fibrous material, said trough progressively curvingly convergingly tapering in a direction from said entrance end portion toward said exit end portion, said trough having a minimum cross-sectional dimension established between said cylindrical surface and said second surface defining a tear-off point for the fibrous material, said tear-off point being upstream of said exit end portion, an imaginary straight line through said tear-off point being in tangential relationship to said second surface and said cylindrical surface, and the radius of curvature of both said first and second surfaces is identical and corresponds to the radius of said first surface defining the maximum cross-sectional dimension of said trough.

2. The apparatus as defined in claim 1 wherein said first surface is a portion of a trough plate and the latter is directly supported by a rigid beam in part defining said second surface, said rigid beam having a length corresponding generally to the axial length of said roll, and support means are provided for generally immovably supporting said rigid beam relative to said first surface.

3. The apparatus as defined in claim 1 including carrier means carrying said first and second surfaces, and means for selectively adjusting the position of said carrier means relative to said roll for selectively varying the cross-sectional size of said trough.

4. The apparatus as defined in claim 1 wherein said first and second surfaces are carried by a carrier, means mounting said carrier for sliding movement toward and away from said rotatable roll whereby the cross-sectional size of said trough can be varied, and screw means having a generally horizontally disposed axis for positioning said carrier selectively at any one of a plurality of positions different distances from said rotatable roll.

5. The apparatus as defined in claim 1 wherein said first surface is a portion of a trough plate and the latter is directly supported by a rigid beam in part defining said second surface, and screw means having a generally horizontally disposed axis for removably securing said trough plate and rigid beam together.

6. The apparatus as defined in claim 4 wherein said first surface is a portion of a trough plate and the latter is directly supported by a rigid beam in part defining said second surface, and screw means having a generally horizontally disposed axis for removably securing said trough plate and rigid beam together.

7. A method of feeding fibrous material to a carding machine of the like comprising the steps of forming a feed trough between a rotatable cylindrical surface and first and second separate surfaces both in opposing relationship to the cylindrical surface with the first surface preceding the second surface in the direction of travel of fibrous material through the trough, the trough having an entrance end portion of an open area greater than the area of an exit end portion, and the trough progressively curvingly converging in a direction from the entrance end portion to a point of minimum cross-sectional area at a tear-off point for the fibrous material at which an imaginary straight line through the tear-off point is in tangential relationship to both the second surface and the cylindrical surface, changing the location of the tear-off point relative to the entrance end portion of the trough to vary the length of fibers combed from the fibrous material during the transport thereof through the trough by substituting another separate surface for and of a different length than the second surface, while maintaining the progressive curving convergence of the trough, and feeding fibrous material through the trough.

* * * * *